US005794918A

United States Patent [19]

Price

[11] Patent Number: 5,794,918

[45] Date of Patent: Aug. 18, 1998

[54] FENCE POST PULLER APPARATUS

[76] Inventor: M. G. Price, 3800 Stoneridge Rd., Austin, Tex. 78739

[21] Appl. No.: 752,832

[22] Filed: Nov. 20, 1996

[51] Int. Cl.[6] ..... E21B 19/00

[52] U.S. Cl. ..... 254/30; 254/21; 254/131; 254/108; 254/113; 254/120

[58] Field of Search ..... 254/30, 29 R, 254/21, 8 R, 2 R, 26 E, 27, 131, 132, 113, DIG. 1, 120

[56] References Cited

U.S. PATENT DOCUMENTS

| | | | |
|---|---|---|---|
| 1,186,799 | 6/1916 | Kistler | 254/131 |
| 1,709,683 | 4/1929 | Pollock, Jr. . | |
| 2,164,031 | 6/1939 | Colt | 254/29 R |
| 2,462,509 | 2/1949 | Kobbe | 254/131 |
| 2,532,533 | 12/1950 | Baldwin et al. | 254/132 |
| 2,777,726 | 1/1957 | Lundgren et al. | 294/2 |
| 2,994,510 | 8/1961 | Michalak | 254/30 |
| 3,779,516 | 12/1973 | King | 254/30 |
| 4,040,601 | 8/1977 | Boardman | 254/133 R |
| 4,161,310 | 7/1979 | Parker | 254/30 |
| 4,726,565 | 2/1988 | Keller | 254/30 |
| 4,738,433 | 4/1988 | Hoff | 254/DIG. 1 |
| 5,022,632 | 6/1991 | Beideck | 254/30 |
| 5,052,659 | 10/1991 | Bates | 254/29 |
| 5,186,437 | 2/1993 | Scott | 245/30 |
| 5,224,687 | 7/1993 | Greckler et al. | 254/30 |
| 5,368,277 | 11/1994 | Moss | 254/30 |
| 5,499,795 | 3/1996 | Matthews | 254/30 |

FOREIGN PATENT DOCUMENTS 188491 1/1957 Germany .

*Primary Examiner*—James G. Smith
*Assistant Examiner*—Lee Wilson
*Attorney, Agent, or Firm*—Shaffer & Culbertson; J. Nevin Shaffer, Jr.

[57] ABSTRACT

An apparatus and method for pulling fence posts having fulcrum stand (B) with an action lever (A) movably connected to one end (A1) of fulcrum stand (B) by hinge (B2). A receiving box (A2*f*), for encompassing the object to be moved, is connected to the action lever (A). An action handle (A3) is attached to the receiving box (A2*f*) and the fulcrum stand (B), and a moveable gripping pawl (A2*d*) is connected to the action handle (A3) for engaging the object to be pulled as the action handle (A3) is raised. The movable gripping pawl (A2*d*) includes two edges, an engagement edge and a non-engagement edge, and a connector (A2*g*) to connect the gripping pawl (A2*d*) to the action handle (A3) so that the object to be pulled is raised by the engagement edge as the action handle (A3) is raised. Because the fulcrum stand (B) and the action handle (A3) are on opposite sides of the post (P) to be pulled, the resulting force applied to the post (P) is primarily free of damaging, rotating, curving forces which, heretofore, have resulted in the posts (P) being bent as they were pulled. Further, because the post (P) is pulled by raising action handle (A3), there is no destabilizing wobble as the device is used.

4 Claims, 3 Drawing Sheets

FENCE POST PULLER APPARATUS

BACKGROUND OF THE INVENTION

The present invention relates to a new and improved concept in extracting posts from the ground; more specifically it relates to the controlled pulling of the popular "T-post," with its row of equally spaced studs centered on and extending along the entire length of the post's flat side.

Manually operated steel post removers have been known for many years. Representative of these are the following: Scott, U.S. Pat. No. 5,186,437; Pollock, U.S. Pat. No. 1,709,683; Baldwin, et al., U.S. Pat. No. 2,532,533; Lungren, et al., U.S. Pat. No. 2,777,726; Michalok, U.S. Pat. No. 2,994,510; Ning, U.S. Pat. No. 3,779,516; Hoff, U.S. Pat. No. 4,738,433; Beideck, U.S. Pat. No. 5,022,632; Bates, U.S. Pat. No. 5,052,659; Moss, U.S. Pat. No. 5,368,277; Parker, U.S. Pat. No. 4,161,310 and Keller, U.S. Pat. No. 4,726,565. Of these prior post pullers that are variously designed to extract steel posts of various configurations, only that of Parker, U.S. Pat. No. 4,161,310 and that of Keller, U.S. Pat. No. 4,726,565 are specifically designed to extract the popular steel T-post, with its centered row of equally spaced studs extending the length of its flat side. Unlike several of the post pullers just listed, these two might not deform the steel post in the process of extracting. But, like most of those listed, their force of upthrust requires a lever-advantaged downthrust of the puller's action handle, which tends to induce a "wobbling" action of the puller, as well as limiting the foot pounds of force that can be applied to the body weight of the operator. Thus, there is a need in the art for providing an apparatus and method for removing steel T-posts: (1) that will not deform the post, (2) that is stable in its action, (3) that is simple in design and therefore, inexpensive to fabricate, and (4) one that is light-weight and easily portable—and that is efficient (i.e., not dependent upon the operator's body weight.)

SUMMARY OF THE INVENTION

Accordingly, the metal fence post puller of the present invention comprises a T-based fulcrum stand, with a composite action lever hinged to the T-based fulcrum stand's upper extremity. The puller's composite action lever comprises a rectangular post-receiving/post-gripping ("PR/PG") frame, fitted at one end with a short hinging feature, i.e. a heavy steel strap extending from within the center of said frame, and fitted at the frame's opposite end with a long, round action handle, and the hinging feature being the centermost member of five such straps of equal thickness, plied together to form the frame's hingeward end. The three inner plies—the hinging member and the two spacers—are so conformed as to create a notched side of the PR/PG's inner square or "box," notched to receive the T-post's stem, with the box's remaining three sides appropriately spaced to accommodate the width of the T-post's studded, flat surface.

Unique to the art is an L-shaped pawl, hinged high within the PR/PG's frame "box," near the frame's base plate. The L-shaped pawl locks beneath one of the T-post's multiple projections or studs when the puller is in its operational mode and the action handle is lifted to raise the post. The L-shaped pawl "ratchets" downward again to a like engagement when the action lever is lowered. Thus, in the preferred embodiment, the action handle is repeatedly raised and lowered so that the T-post is pulled incrementally from the ground. Close proximity of the PR/PG frame to the fulcrum stand provides short, vertical upthrusts that (in addition to enhancing the operator's mechanical advantage) eliminates any chance of bending the post that would be caused by a long, circumliniar upward force.

BRIEF DESCRIPTION OF THE DRAWINGS

Other objects, advantages and features of the present invention will become more fully apparent from the following description of the preferred embodiment, the appended claims, and the accompanying drawings in which:

DESCRIPTION OF PREFERRED EMBODIMENT

Figure 1:
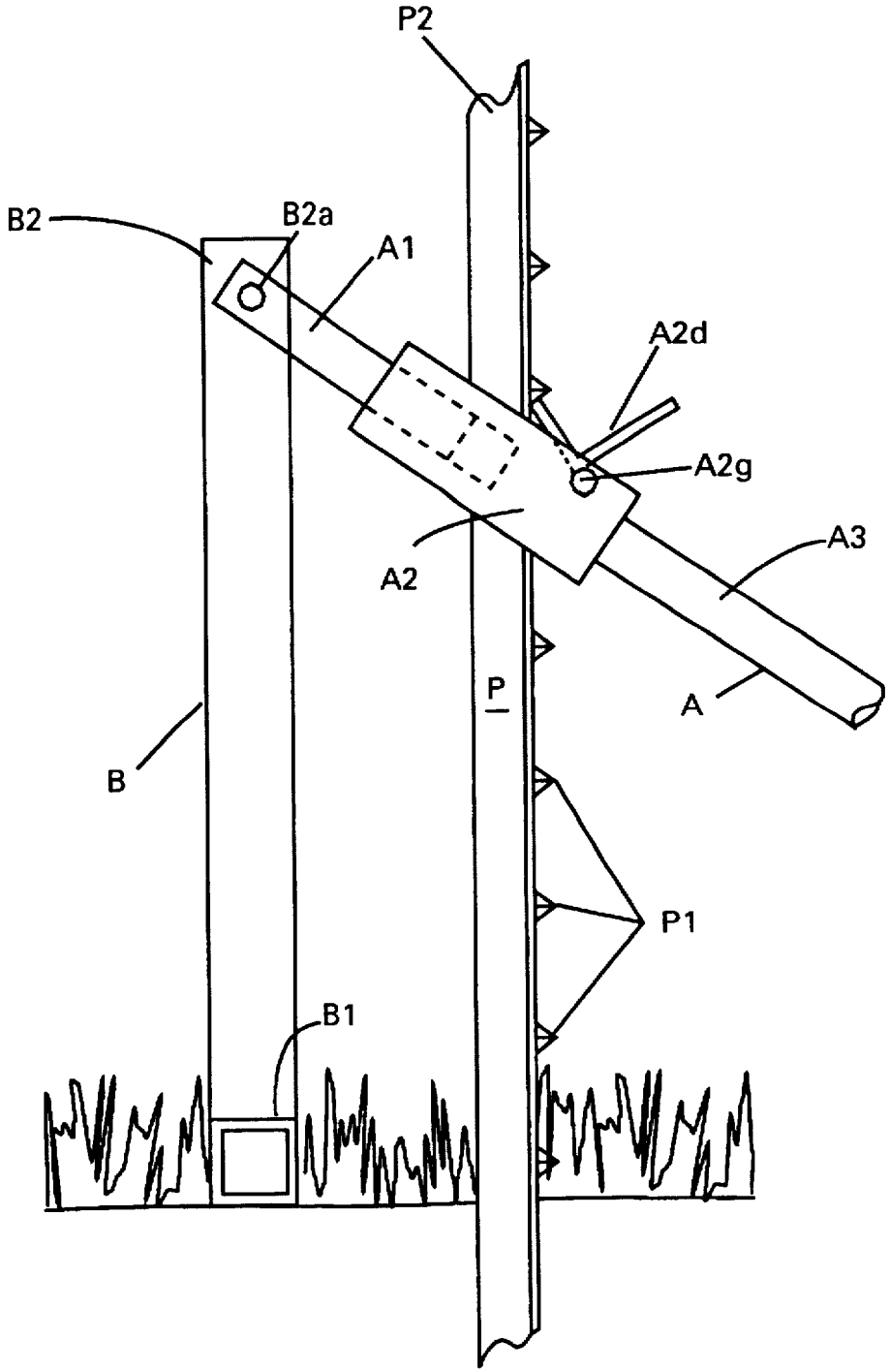
FIG. 1 is a side perspective of the preferred embodiment in its post-pulling attitude.
Figure 2:
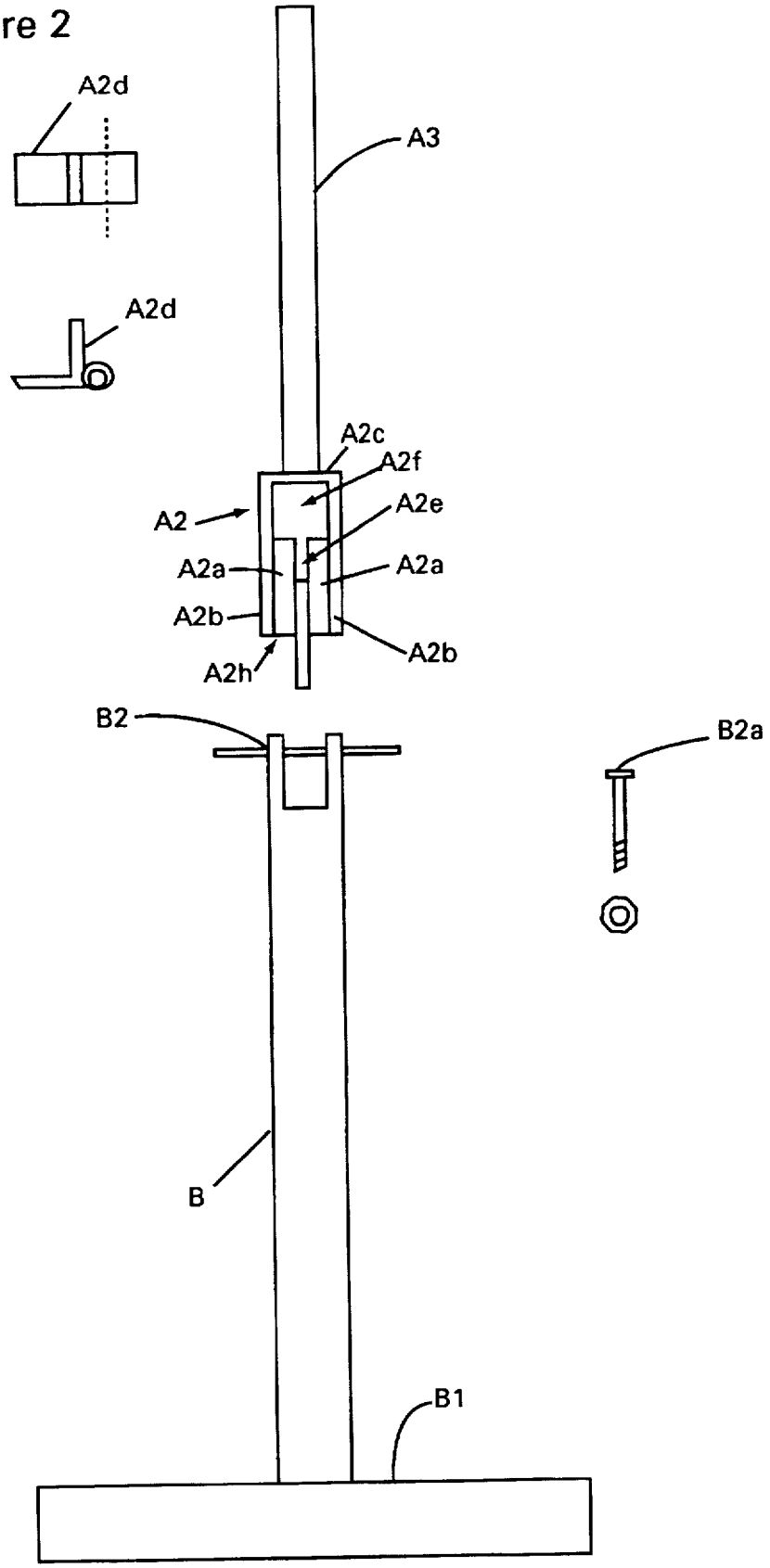
FIG. 2 is an exploded view of the invention.
Figure 3:
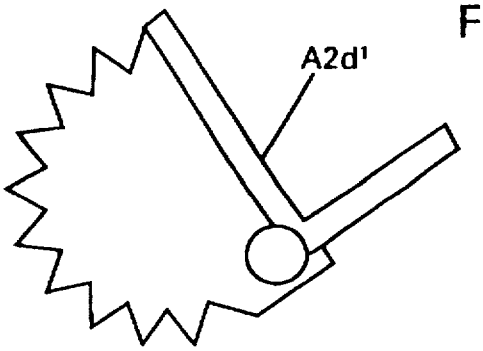
FIG. 3 is another embodiment of the pawl of the present invention.
Figure 4:
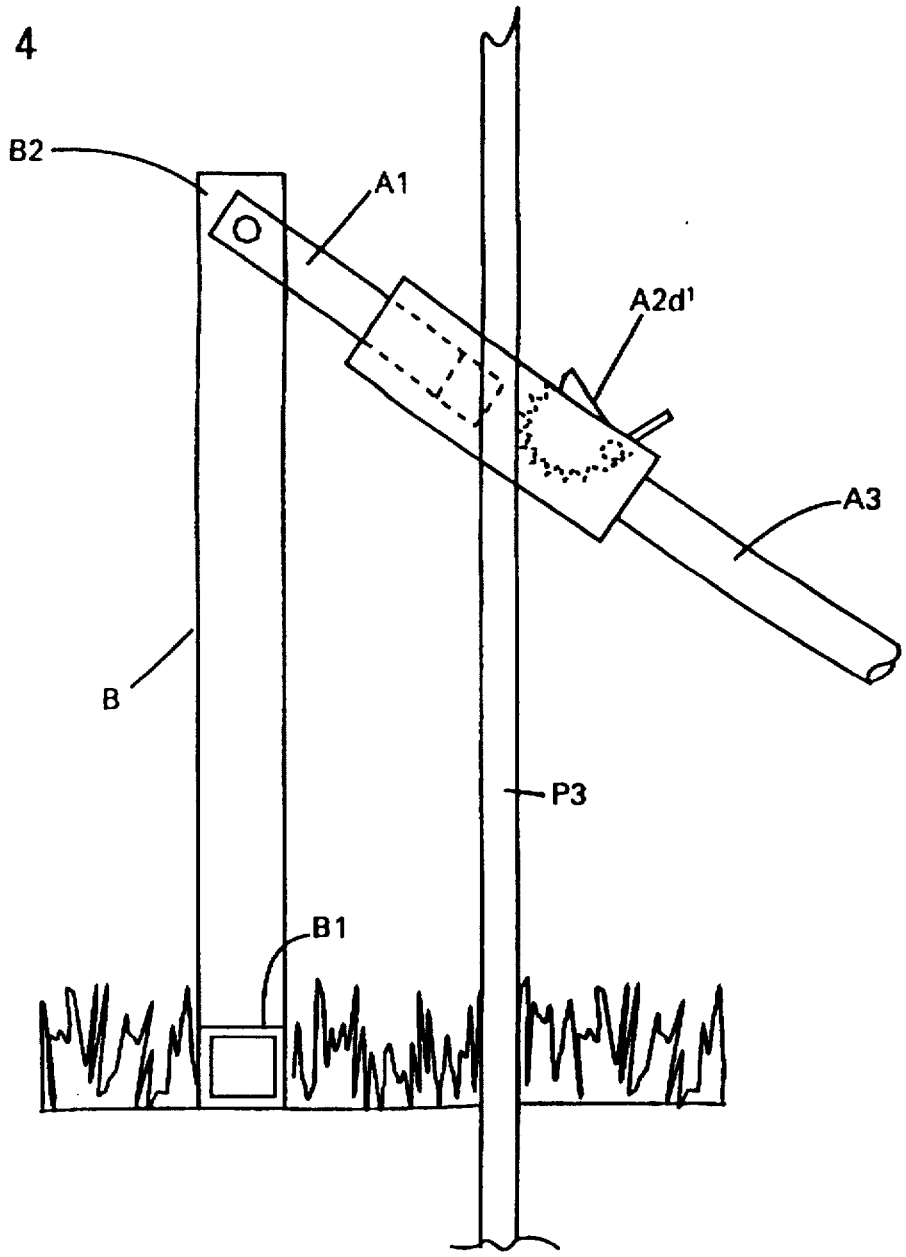
FIG. 4 is a side perspective, partially cut away view of the invention utilizing the pawl of FIG. 3.

The preferred invention is illustrated by way of example in FIGS. 1, 2, 3, and 4. With specific reference to FIGS. 1 and 2: a post puller is illustrated comprising an upright fulcrum stand (B), featuring a horizontal "T" base (B1) and an upper hinging feature (B2) by bolt (B2*a*), thus conformed to receive one end (A1) of puller's action lever (A). Action lever (A) includes hinging feature (A1), an elongated post-receiving/post gripping (PR/PG) frame (A2), and a long action handle (A3) attached thereto. Hinging end (A1) of action lever (A) is an elongated steel plate extended from within one end (A2*h*) of the PR/PG frame (A2), and being the center-most of five such plates plied together to form the frame's hinged end (A1), with the two inner members (A2*a*) serving as spacers and the outer two members (A2*b*) forming the frame's elongated sides that join with base plate (A2*c*) to complete the frame's rectangular configuration. Within the PR/PG frame (A2), spacers (A2*a*) are so arranged that their innermost ends, with the frame's two sideplates (A2*b*) and the frame's base plate (A2*c*), form a square post-receiving box or chamber (A2*f*) slotted on one side at (A2*e*), where center-plied hinging feature (A1) is inset to form a recess or notch (A2*e*) to accommodate the post's "stem" (P2). Thus is formed a precisely fitted square (A2*f*) notched at (A2*e*) at the square's hingeward side. Fitted at the top, near the frame's base plates (A2*c*) and hinged with bolt (A2*g*), is an L-shaped pawl (A2*d*) for locking beneath the T-post's multiple, equally spaced protrusions or studs (P1).

In operation, the PR/PG feature (A2) is lowered over and down from the top of the standing post (P) so that it closely encompasses the post (P), until its fulcrum stand (B) is standing parallel to the post (P), its T-base (B1) resting on the ground, with its L-shaped pawl (A2*d*) ratcheting downward over post's multiple studs (P1), until the action handle (A3) comes to rest in a horizontal attitude—or lower, if desired. When action lever (A) is raised, gripping pawl (A2*d*) locks automatically beneath the post's most proximate stud (P1), enabling the operator, with the mechanical advantage of the lever's long handle, (A3) to lift the post upward. When action lever (A) is again lowered, gripping pawl (A2*d*) ratchets downward over post's multiple studs (P1), again locking beneath one of these studs (P1) as action lever (A) is again raised, thus extracting the post (P) incrementally from the ground.

Inventor has found that because fulcrum stand (B) is positioned on the opposite side of the post (P) from the action handle (A3), the upward forces on post (P) can be short, totally eliminating any circumliniar action that causes bending. Inventor has found also that the lifting action of the action lever (A)—as opposed to that of devices, methods or machines that require a downward force—eliminates certain instability (wobbling) and is more adaptable to the best use of an operator's strength and energy—as opposed to being dependent upon the operator's size and body weight. Thus, with the invention's long handle, removing a T-post from the ground without bending or deforming it, requires only seconds, under normal conditions.

While the post puller of the present invention has been disclosed in connection with the extracting of the popular T-post, it should be appreciated that the present invention can be used in other situations wherein the object to be extracted is conformed with a row of equally spaced studs and providing the PR/PG (A2) can encompass its outside dimensions. Furthermore, the present invention is capable of extracting any square or round steel post (P3)—such as square tubing or round pipe—by removing the conventional L-pawl (A2*d*) and replacing it with the puller's auxiliary pawl, a convexed, tempered steel jaw (A2*d*) (see FIGS. 3 and 4). Thus, this feature of versatility gives it the capability to extract from the ground any steel rod or pipe or post that can be encompassed within the PR/PG box.

The present invention, with only two moving parts, is easy to manipulate. Its light weight makes it very portable. Its simplicity of design makes it inexpensive to fabricate. Thus, the puller of the present invention incorporates significant advantages over prior art pullers, some of which appear to be fragile or otherwise impractical and/or not designed to remove steel posts in like-new condition.

The above described preferred embodiments are intended to illustrate the principles of the invention, but not to limit the scope of the invention. Various other embodiments and modifications to these preferred embodiments may be made by those skilled in the art without departing from the scope of the following claims.

I claim:

1. An apparatus for removing posts comprising:

a) a fulcrum stand;

b) an action arm movably connected on one end to the fulcrum stand;

c) a receiving means connected to the action arm for encompassing an object to be pulled;

d) an action handle attached to the receiving means so that the object to be pulled is between the action handle and the fulcrum stand; and e) a movable grip means connected to the action handle for engaging the object to be pulled as the action arm is raised.

2. The apparatus of claim 1 wherein the fulcrum stand further comprises:

a) an upright section conformed at one end to movably engage one end of the action arm; and b) a horizontal base section connected to the upright section.

3. The apparatus of claim 2 wherein the receiving means further comprises:

a) a base plate attached to the action handle;

b) two oppositely positioned side members connected to the base plate;

c) two oppositely positioned action arm spacers connected to the side members; and d) the action arm connected to the action arm spacers so that an object encompassing space is created by a combination of a base plate, side members, and spacers.

4. The apparatus of claim 3, wherein the moveable grip means further comprises:

a) bracket with two edges, an engagement edge and a non-engagement edge; and b) a means for connecting the bracket to the action handle so that the object to be pulled is engaged by the engagement edge as the action handle is raised.

* * * * *